US006006360A

United States Patent [19]

Reed

[11] Patent Number: 6,006,360

[45] Date of Patent: Dec. 28, 1999

[54] PROTECTIVE HOOD FOR FIREFIGHTERS

[76] Inventor: Clifford C. Reed, 7114 Camino Verde, Houston, Tex. 77083

[21] Appl. No.: 09/181,882

[22] Filed: Oct. 29, 1998

[51] Int. Cl.[6] ..... A42B 1/04

[52] U.S. Cl. ..... 2/202; 2/5; 2/7

[58] Field of Search ..... 2/5, 7, 8, 84, 202, 2/203, 205

[56] References Cited

U.S. PATENT DOCUMENTS

| | | | |
|---|---|---|---|
| 4,573,217 | 3/1986 | Reed | 2/7 |
| 5,090,054 | 2/1992 | Grilliot et al. | 2/5 |
| 5,109,549 | 5/1992 | Mattinson | 2/202 |

*Primary Examiner*—Diana Oleksa

*Attorney, Agent, or Firm*—Watson Cole Grindle Watson, P.L.L.C.

[57] ABSTRACT

A head portion has an open front portion through which a face mask extends. The front portion is elastically biased into engagement with the mask to provide a good seal between the front portion and the face mask. A skirt extends from the lower part of the head portion and flares downwardly and outwardly to overlap the collar of a firefighter coat to provide a good seal with the coat and prevent entry of debris between the skirt and the collar. A flap has one end permanently secured to the head portion and the skirt; and the opposite end of the flap is detachably connected to the head portion. A thermal liner is permanently secured to the head portion and skirt and is spaced from both the topmost part of the head portion and the opposite end of the flap.

5 Claims, 2 Drawing Sheets

PROTECTIVE HOOD FOR FIREFIGHTERS

BACKGROUND OF THE INVENTION

The present invention relates to a protective hood used by a firefighter who is wearing a face mask and a firefighter coat having a collar. This invention is an improvement over my U.S. Pat. No. 4,573,217, the disclosure of which is incorporated herein by reference.

My previous patent discloses a construction which overcame certain problems encountered in the prior art. However, such a construction proved to have certain deficiencies which need to be rectified.

A particular problem with the structure shown in my patent is that the hood does not interface well with the collar of a firefighter suit worn by a firefighter. The lower portion of the hood is designed to fit within the collar so that the coat overlaps the bottom of the hood. This arrangement does not provide an effective seal between the hood and the coat, and debris can enter the coat through at this location which of course is extremely undesirable. It is therefore an object of the invention to provide a satisfactory seal between the hood and an associated firefighter coat.

A further problem with the structure shown in my patent occurs between the hood and a face mask worn by a firefighter during firefighting operations. The hood has an open front portion through which the face mask extends. The interface between the open front portion and the mask does not always protect the face of the firefighter because gaps may be formed in the interface through which debris may enter into the face mask. A further object of the invention is to provide a good seal between the open front portion of the hood and the mask.

SUMMARY OF THE INVENTION

The hood of the invention includes a head portion having an open front portion through which a face mask worn by the firefighter extends. This open front portion has elastic means disposed therealong so that the open front portion is elastically biased into engagement with the mask throughout the length of the open front portion so as to prevent any gaps from being formed in the interface between the open front portion of the hood and the face mask. This ensures that no debris can enter at this interface.

The hood also includes a skirt which extends from this lower part of the head portion and flares downwardly and outwardly to overlap the collar of a firefighter coat worn by the firefighter. This provides a good seal with the coat and prevents any debris from entering the coat between the hood and the collar of the coat. The opposite ends of the skirt may not meet or overlap with one another, and in this case, any gap which may occur between such opposite ends is bridged by a flap which will prevent any debris from entering the coat.

The flap has one end permanently secured to the head portion and the skirt, while the opposite free end of the flap may be detachably connected to the head portion of the hood. A thermal liner is permanently secured to the head portion and skirt and is spaced from the topmost part of the head portion as well as the free end of the flap.

DESCRIPTION OF THE PREFERRED EMBODIMENT

Figure 1:
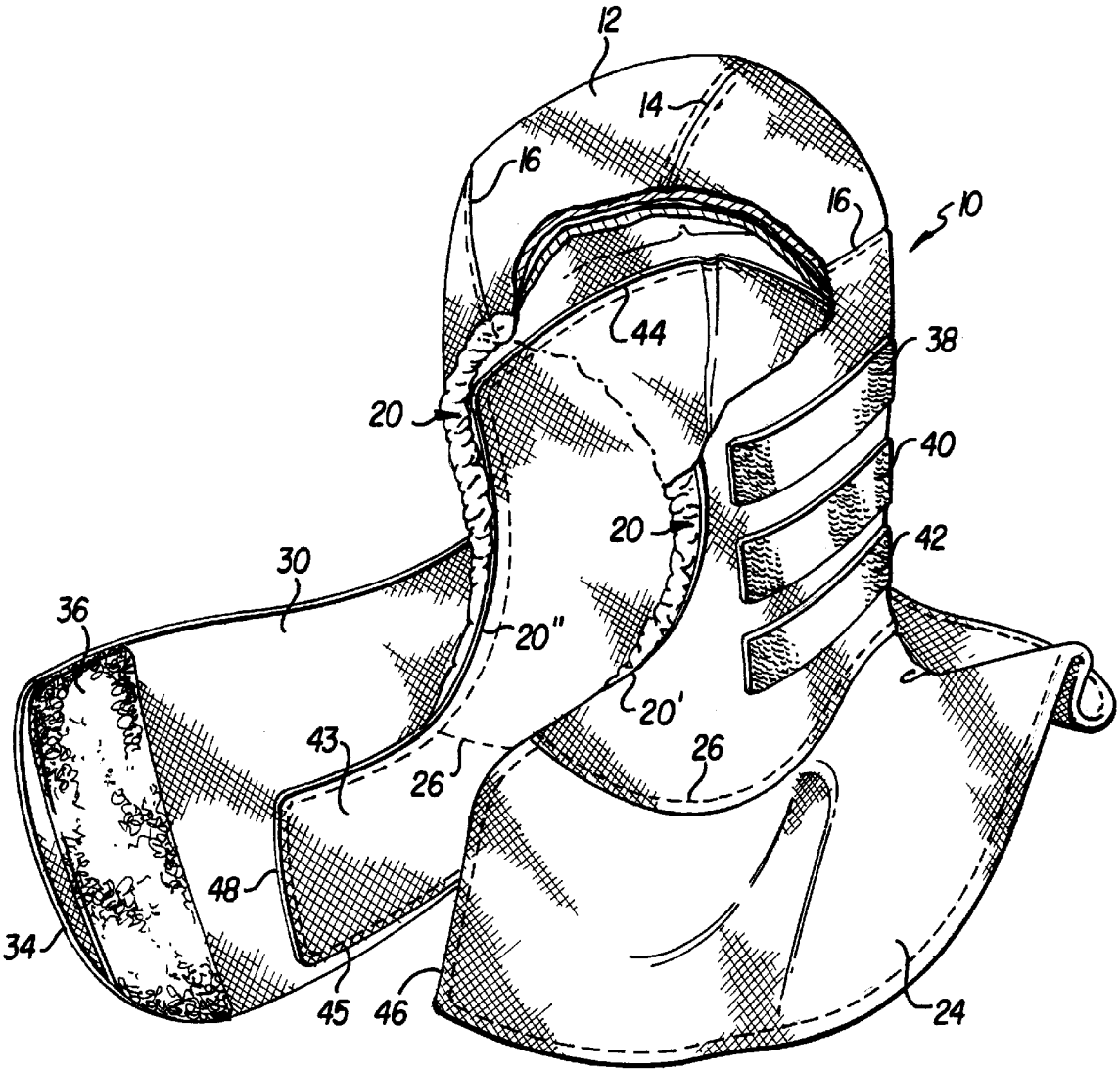
FIG. 1 is a top perspective view partly broken away of the invention hood.

Referring to the drawings wherein like reference characters designate corresponding parts throughout the several views, the hood as shown in FIG. 1 includes a head portion 10 formed of two layers of conventional fire resistant material. A topmost portion 12 of the head portion includes a central seam 14 which extends from the front to the back of portion 12 and a seam 16 which extends around the topmost portion and which intersects central seam at the back of portion 12.

The head portion includes an open front portion 20 which is of generally inverted U-shaped configuration through which the front of a face mask worn by a firefighter is adapted to extend. It is noted that part of the open front portion has been cut away to reveal the internal construction of the hood, it being understood that portion 20 extends continuously across the front of the hood as indicated by the phantom line in FIG. 1. Portion 20 is gathered from one end thereof to the other and has an elongated elastic member disposed therein and extending between the opposite ends of the open front portion to elastically bias portion 20 into tight engagement with an associated face mask. This ensures that an effective seal is provided between the hood and a face mask to prevent entry of debris into the interior of the face mask.

A skirt 24 is formed of two layers of conventional fire resistant material and is connected to the lower part of the head portion by stitching 26 extending around the hood from points adjacent the lower opposite ends of front portion 20. The skirt flares downwardly and outwardly from the lower part of the head portion and is of such a dimension that it is adapted to overlap the collar of a firefighter coat worn by a firefighter and provide a good seal with the shoulder portion of the coat. This prevents entry of debris between the skirt and collar of the coat. In a typical example, when the hood is in operative position, the lower edge of the skirt is positioned about 4 to 5 inches from the neck line of the associated coat.

Figure 2:
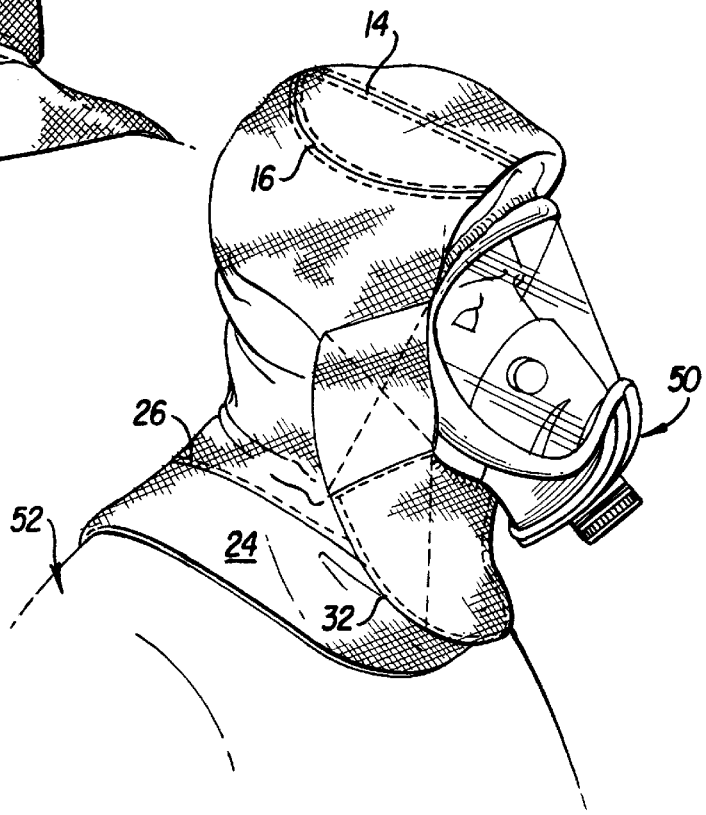
FIG. 2 is a top perspective view showing a firefighter wearing a mask and a firefighter coat with the hood disposed in operative position over the head of the firefighter.

As seen in FIG. 2, a flap 30 is formed of two layers of conventional fire resistant material and has one end 32 thereof permanently secured to the head portion and the skirt by stitching. End 32 of flap 30 overlaps one end of the skirt. As seen in FIG. 1, the opposite end 34 of the flap has a strip 36 of hook and loop fastener VELCRO stitched to the inwardly facing side of the flap. Strip 36 is adapted to cooperate as described hereinafter with three strips 38, 40 and 42 of hook and loop fastener VELCRO which are stitched to the outwardly facing side of head portion 10. The strips include hook and loop elements which cooperate with one another in a well-known manner.

A thermal liner 43 formed of conventional thermal material is permanently secured by stitching to the inwardly facing sides of the head portion 10, skirt 24 and flap 30. The top edge 44 of liner 43 is spaced from the topmost part 12 of the head portion. The bottom edge 45 of the liner is disposed adjacent the lower edge of the skirt and the flap, the lower edges of the skirt and flap being generally aligned with one another. The liner extends around the inner surface of the head portion to the side 20' of open portion 20 and also extends to an end edge 46 of the skirt. The liner also extends to the side 20" of open portion 20. A further portion of the liner terminates in an end edge 48 which is spaced from end 34 of the flap.

Referring to FIG. 2, a firefighter is shown wearing a conventional firefighter face mask 50, and the hood has been placed in operative position over the head of the firefighter. In this position, skirt 24 of the hood overlaps the collar (not shown) of a conventional firefighter coat 52 and forms a good seal with the shoulder portion of the coat. The face mask projects through the open front portion of the hood, and the edges of the front portion are biased into sealing engagement with adjacent portions of the face mask. Flap 30 extends under the face mask in engagement with the undersurface of the mask and extends to a position where the hook and loop fastener VELCRO mounted on the inwardly facing surface of the flap engages the hook and loop fastener VELCRO mounted on the outwardly facing surface of the head portion. This provides a connecting means for detachably connecting the flap to the head portion and enables the hood to be adjusted for different size heads of firefighters.

Figure 3:
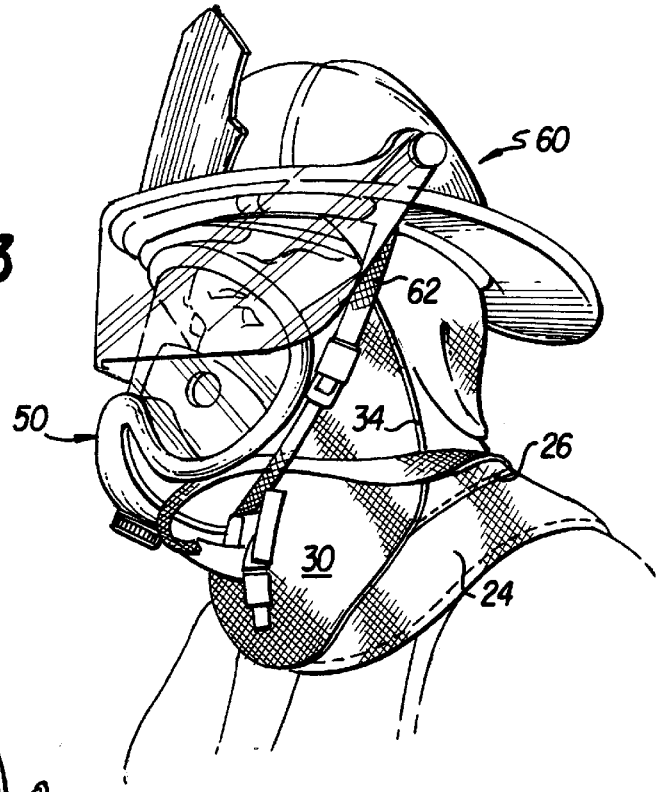
FIG. 3 is a perspective view of the firefighter with a firefighter helmet in position over the hood.
Figure 4:
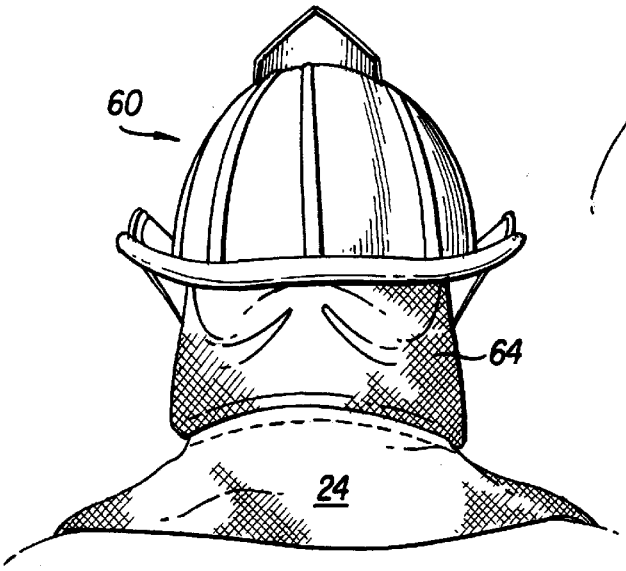
FIG. 4 is a rear view of the firefighter shown in FIG. 3.

As seen in FIGS. 3 and 4, a conventional firefighter helmet 60 has been placed over the hood a shown in FIG. 2. The helmet includes the usual chin strap 62 which has the ends thereof secured to opposite sides of the helmet in the usual manner. As seen in FIG. 4, the helmet includes a conventional drape 64 which overlies part of the head portion of the hood.

The invention has been described with reference to a preferred embodiment. Obviously, various modifications, alterations and other embodiments will occur to others upon reading and understanding this specification. It is my intention to include all such modifications, alterations and alternate embodiments insofar as they come within the scope of the appended claims or the equivalent thereof.

What is claimed is:

1. A protective hood for a firefighter wearing a face mask and a firefighter coat having a collar comprising, a fire resistant head portion including an open front portion through which a face mask is adapted to extend, said head portion including an upper part and a lower part, said front portion being of generally inverted U-shaped configuration to define opposite sides joined only at said upper part with the remainder of the two sides being free of one another, said opposite sides terminating in lower ends defining lower opposite ends of said front portion, a fire resistant skirt having opposite ends, said skirt extending from said lower part and flaring downwardly and outwardly from said lower part and being adapted to overlap a collar of a firefighter coat to provide a good seal therewith, said skirt being connected to said lower part of the head portion by stitching extending around the hood from points adjacent said lower opposite ends of said front portion, a fire resistant flap having opposite ends, one of said ends of the flap overlapping one end of said skirt and being permanently secured to said head portion adjacent one of said sides and being permanently secured to said skirt adjacent said one end of said skirt, the other of said sides being generally aligned with the opposite end of said skirt, and connecting means for detachably connecting the opposite end of said flap to said head portion.

2. A hood as defined in claim 1 wherein said open front portion includes elastic means adapted to bias the open front portion into engagement with said face mask to provide an effective seal with said mask and prevent entry of debris between said open front portion and said mask.

3. A hood as defined in claim 1 wherein said connecting means comprises hook and loop portions enabling quick and simple manual manipulation.

4. A hood as defined in claim 1 including a thermal liner permanently secured to said head portion and said skirt, said head portion including a topmost part, said thermal liner being spaced from said topmost part.

5. A protective hood for a firefighter wearing a face mask and a firefighter coat having a collar comprising, a fire resistant head portion including an open front portion through which a face mask is adapted to extend, said head portion including a lower part, a fire resistant skirt extending from said lower part and flaring downwardly and outwardly from said lower part and being adapted to overlap a collar of a firefighter coat and provide a good seal therewith, a fire resistant flap having opposite ends, one of said ends being permanently secured to said head portion and said skirt, connecting means for detachably connecting the opposite end of said flap to said head portion, a thermal liner permanently secured to said head portion and said skirt, said head portion including a topmost part, said thermal liner being spaced from said topmost part, said thermal liner also being spaced from said opposite end of said flap.

* * * * *